United States Patent [19]

George

[11] Patent Number: 4,757,856

[45] Date of Patent: Jul. 19, 1988

[54] METHOD AND APPARATUS FOR CASTING ARTICLES

[75] Inventor: Thomas George, Euclid, Ohio

[73] Assignee: PCC Airfoils, Inc., Cleveland, Ohio

[21] Appl. No.: 88,148

[22] Filed: Aug. 21, 1987

[51] Int. Cl.[4] ..... B22D 27/04

[52] U.S. Cl. ..... 164/122.1; 164/137; 164/339; 164/353

[58] Field of Search ..... 164/122, 122.1, 122.2, 164/125, 127, 129, 137, 338.1, 339, 350, 352, 353

[56] References Cited

U.S. PATENT DOCUMENTS 3,810,504 5/1974 Piwonka ..... 164/122.1

4,673,021 6/1987 Graham et al. ..... 164/122.1

*Primary Examiner*—Nicholas P. Godici

*Assistant Examiner*—Richard K. Seidel

*Attorney, Agent, or Firm*—Tarolli, Sundheim & Covell

[57] ABSTRACT

A mold structure has a plurality of article molds disposed in an array with an open central space. A gating system is connected with upper ends of the article molds and a base is connected with lower ends of the article molds. A baffle plate is inserted into the open central space between the article molds. The baffle plate has an area which is greater than the area of an opening in the base. A lower side of the baffle plate overlies an area on the base which extends completely around the opening in the base. To insert the baffle plate through the opening in the base, a slit is formed in the baffle plate. A portion of the base is received in the slit and then the baffle plate is rotated to turn it through the opening in the base. An alternative method of inserting the baffle plate is by partially folding the baffle plate and inserting the folded baffle plate through the opening in the base of the mold structure. Once the folded baffle plate has been moved into the open space between the article molds, the baffle plate is unfolded.

36 Claims, 3 Drawing Sheets

METHOD AND APPARATUS FOR CASTING ARTICLES

BACKGROUND OF THE INVENTION

The present invention relates to a method and apparatus in which a baffle plate is disposed in an open central space in a mold structure to retard the transfer of heat from article molds.

A mold structure having a plurality of article molds disposed in an array with an open central space is disclosed in U.S. Pat. No. 3,810,504, issued May 14, 1974 and entitled "Method for Directional Solidification". The apparatus disclosed in this patent includes an annular chill plate. A baffle plate is disposed in the open central space to retard the transfer of heat from the article molds to the chill plate. The baffle plate is slightly smaller than an opening in the base of the mold structure to enable the mold structure to be moved into and out of a furnace on the annular chill plate.

A mold structure having a plurality of article molds disposed in an array with an open central space is also disclosed in U.S. Pat. No. 4,673,021, issued Jun. 16, 1987 and entitled "Method and Apparatus for Casting Articles". This patent discloses the concept of obtaining a large temperature gradient with a baffle which blocks the radiation of heat from an open central space in an array of article molds as they are withdrawn from a furnace. The baffle is supported from a gating system by a support post which extends downwardly from the gating system. The construction of the gating system is complicated by the necessity of forming the baffle with its support post extending from the gating system.

The mold of the aforementioned U.S. Pat. No. 4,673,021 has an annular base plate which is connected with the lower end portions of the article molds to provide a stable base for the article molds. The base plate interconnects the article molds and holds them against movement relative to each during the casting of articles. In addition, the base plate enables a fluid tight seal to be obtained between open lower end portions of the article molds and a chill plate. In order to obtain a stable mold structure and to obtain a fluid tight seal between the open lower end portions of the article molds and the chill plate, it is advantageous to make the base plate relatively wide.

A mold structure having an open central space in which a baffle plate is disposed is disclosed in U.S. patent application Ser. No. 13,469, filed Feb. 11, 1987 by Lawrence D. Graham et al., and entitled "Apparatus and Method for Use in Casting Articles". This application discloses the concept of supporting a baffle plate in the open central space between article molds with a support structure which extends through a chill plate.

SUMMARY OF THE INVENTION

The present invention provides a new and improved method and apparatus for use in casting a plurality of articles. The apparatus includes a mold structure having article molds disposed in an array with an open central space in which a baffle plate is disposed. The baffle plate has an area which is greater than the area of an opening in the base. The baffle plate overlies an area on the base extending around the opening.

Since the baffle plate overlies an area on the base which extends around the opening, the periphery of the baffle plate is relatively close to the article molds. Therefore, when the mold structure is lowered from a furnace, the stationary baffle plate is effective to establish a relatively large heat gradient between the portions of the article molds disposed above the baffle plate and the portions of the article molds disposed below the baffle plate.

The baffle plate is inserted into the open central space between the article molds through an opening in the base of the mold structure. The opening in the base of the mold structure is smaller than the baffle plate. Therefore, various methods have been developed to insert the baffle plate through the opening.

One of the methods for inserting the baffle plate through the opening includes providing a slit in the baffle plate. The base of the mold structure is received in the slit. The baffle plate is then rotated to turn the baffle plate through the opening in the base of the mold structure into the open central space between the article molds. An alternative method for inserting the baffle plate is to partially fold the baffle plate before inserting it through the opening. The baffle plate is unfolded when it is in the space between the article molds.

The inserting of the baffle plate into the open central space between the article molds is advantageously accomplished with the mold structure in an upside down orientation, that is with the base of the mold structure upward. Once the baffle plate has been inserted, the mold structure is turned over so that the base of the mold is downward. The mold structure is then positioned on a chill plate with the baffle plate in the open central space between the article molds.

Accordingly, it is an object of this invention to provide a new and improved method and apparatus in which a baffle plate having an area which is greater than the area of an opening in the base of a mold structure is inserted through the opening in the base of the mold structure into an open central space between article molds.

Another object of this invention is to provide a new and improved method and apparatus wherein a baffle plate is inserted into an open central space in a mold structure with the mold structure in a first orientation, the mold structure is then positioned on a chill plate in a second orientation.

Another object of this invention is to provide a new and improved method and apparatus wherein a baffle plate is inserted into an open central space between a plurality of article molds by inserting a portion of a base of the mold structure into a slit formed in the baffle plate.

Another object of this invention is to provide a new and improved method and apparatus in which a folded baffle plate is inserted into an open central space between a plurality of article molds and is then unfolded.

BRIEF DESCRIPTION OF THE DRAWINGS

The foregoing and other objects and features of the present invention will become more apparent upon a consideration of the following description taken in connection with the accompanying drawings, wherein.

DESCRIPTION OF SPECIFIC PREFERRED EMBODIMENTS OF THE INVENTION

Casting Apparatus

Figure 2:
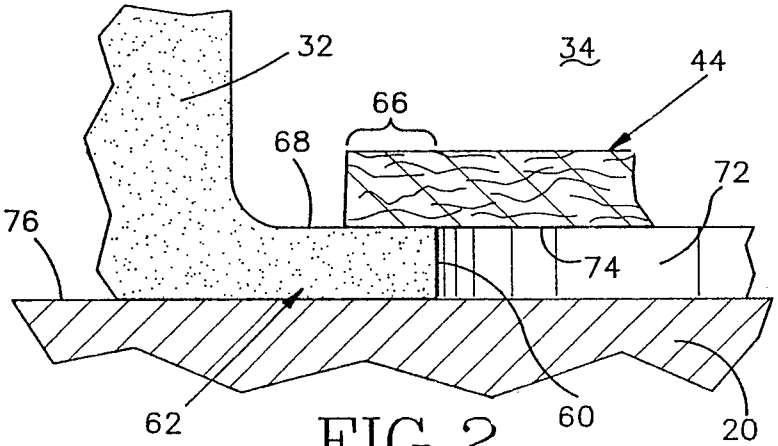
FIG. 2 is an enlarged fragmentary illustration of a portion of FIG. 1 and illustrating the relationship between the baffle plate, base of the mold structure and chill plate.

A casting apparatus 10 (FIG. 1) includes a fluid tight housing 12 which encloses an induction furnace 14 having a cylindrical susceptor housing 16 and a induction coil 18. A circular water cooled copper chill plate 20 is mounted on a cylindrical support post 22 which is movable vertically up and down relative to the furnace 14 and housing 12 by a reversible motor 24. The general construction of the housing 12 and furnace 14 is well known and may be similar to that shown in U.S. Pat. No. 3,841,384, issued Oct. 15, 1974 for "Method and Apparatus for Melting and Casting Metal".

Figure 1:
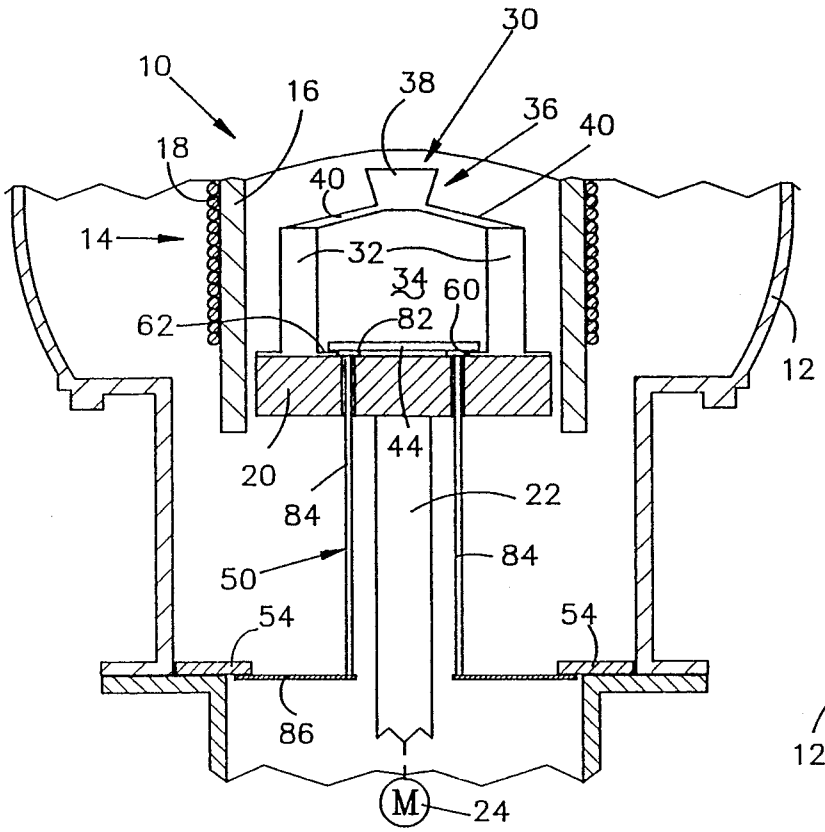
FIG. 1 is a schematic illustration depicting a chill plate, mold structure, baffle plate and furnace when the mold structure is entirely within the furnace.

A one-piece ceramic mold structure 30 is supported on the circular chill plate 20. The mold structure 30 includes a plurality of article molds 32 disposed in an annular array about an open central space 34. It should be understood that although only two article molds 32 are illustrated in FIG. 1, additional article molds are arranged in a circular array in a manner similar to that disclosed in U.S. Pat. No. 4,673,021 issued Jun. 16, 1987 and entitled "Method and Apparatus for Casting Articles".

The one-piece ceramic mold structure 30 includes a gating or molten metal distribution system 36 which extends across the open central space 34 to the article molds 32. The gating system 36 includes a pour cup 38 which is connected with each of the article molds 32 by a plurality of runners 40. The runners 40 extend radially outwardly from the pour cup 38 in a manner similar to that disclosed in U.S. Pat. No. 3,680,625, issued Aug. 1, 1972 and entitled "Heat Reflector", and U.S. Pat. No. 4,550,764, issued Nov. 5, 1985 and entitled "Apparatus and Method for Casting Single Crystal Articles".

A circular baffle plate 44 is disposed in the open central space 34. The baffle plate 44 retards the transfer of heat from the article molds 32 through the open central space 34 of the array of article molds 32 to the chill plate 20. This facilitates preheating the mold structure and maintaining the metal in the lower portions of the article molds 32 molten during pouring of the molten metal in the mold structure 30.

The baffle plate 44 can be made of any desired material, for example, a heat insulating or reflecting material. The baffle plate 44 is formed of graphite and has upper and lower sides formed of graphite foil with graphite fibers disposed between the layers of foil. In one specific instance, the baffle plate 44 was formed of heat insulating graphite material which is commerically available under the trademark "GRAPHFOIL". Of course, other known heat insulating materials could be utilized if desired.

The baffle plate 44 is supported by a support structure 50 which extends through the chill plate 20. The support structure 50 supports the baffle plate 44 in a stationary relationship with the furnace housing 16 during an initial portion of the withdrawal of the mold structure 30 from the furnace 14. During a final portion of withdrawal of the mold structure 30 from the furnace 14, the baffle plate 44 and support structure 50 move downwardly with the chill plate 20.

The support structure 50 is initially held stationary by retainers 54 which are fixedly connected to the housing 12. In one specific embodiment of the invention, the retainers 54 were magnets. Of course, other types of retainer devices could be used if desired. The construction of the baffle support structure 50 is disclosed in U.S. patent application Ser. No. 013,469, filed Feb. 11, 1987 by Lawrence D. Graham et al. and entitled "Method and Apparatus for Use in Casting Articles."

In accordance with a feature of the present invention, the baffle plate 44 has an area which is greater than the area of an opening 60 in an annular base 62 of the mold structure. The baffle plate 44 overlies an area on the base 62 which extends completely around the opening 60. Therefore, the circular periphery of the baffle plate 44 is closely adjacent to the article molds 32. The baffle plate 44 is effective to block the transfer of heat from the article molds 32 through the portion of the open central space 34 above the baffle plate to the chill plate 20. The establishing of a relatively high temperature gradient across the baffle plate 44 is promoted by the fact that there is very little space between the periphery of the baffle plate and the article molds 32.

The base 62 is an annular ceramic plate having a circular central opening 60. Open lower ends of the article molds 32 are exposed to the chill plate 20 through openings in the base 62. The relatively wide annular base 62 has a substantial surface area in abutting engagement with an upper side surface of the chill plate 20 to provide a fluid tight seal between the lower ends of the article molds and the chill plate 20. In addition, the relatively wide base 62 is integrally formed with each of the article molds 32 and holds the article molds against movement relative to each other while providing a stable support for the mold structure 30.

When the mold structure 30 is entirely within the furnace 14, as shown in FIG. 1, an annular rim portion 66 (FIG. 2) of the baffle plate 44 overlaps and is disposed in abutting engagement with an annular upper side surface 68 of the base 62. Therefore, the baffle plate 44 completely blocks the opening 60 to retard the transfer of heat from the open central space 34 to the chill plate 20 through the opening 60 during preheating of the mold structure 30 and during pouring of molten metal into the article molds. The heat insulating effect of the baffle plate 44 is promoted by a circular dead air space 72 (FIG. 2) formed between the circular bottom surface 74 of the baffle plate 44 and a circular upper side surface 76 of the chill plate 20.

When articles are to be cast in the mold structure 30, the mold structure is placed on the chill plate 20 while the chill plate is in a fully lowered position (not shown) adjacent to the lower end of the housing 12 (FIG. 1). At this time, the circular baffle plate 44 is disposed in the open central space 34 between the article molds 32. The lower side surface 74 of the baffle plate is disposed in abutting engagement with the upper side surface 68 of the base 62 in an annular area which extends completely around the circular opening 60 in the base. At this time, the support structure 50 is suspended from the chill plate 20 by engagement of retainer heads 82 on the upper end of support rods 84 on the support structure 50 with the chill plate 20.

The motor 24 is then operated to move the support post 22, chill plate 20, mold structures 30 and baffle support structure 50 upwardly in the housing 12. During this upward movement, the chill plate 20 and mold structure 30 move upwardly past the retainers 54 and enter the furnace 14. As the chill plate approaches the raised position of FIG. 1, an annular metal base plate 86 of the support structure 50 is magnetically engaged by the retainers 54 and held in place.

The housing 12 is then evacuated. The induction coil 18 is then energized to preheat the one-piece ceramic mold structure 30 to a relatively high temperature, approximately 2,800° F. During preheating of the mold structure, the copper chill plate 20 is cooled by a flow of liquid through the chill plate. During preheating, the baffle plate 44 overlies the upper side surface 68 of the mold base 62 and the upper side surface 76 of the chill plate 20 to retard the transfer of heat from the article molds 32 to the chill plate.

Once the mold 30 has been preheated, molten metal is poured into the pour cup 38 and conducted through the runners 40 to the article molds 32. The molten metal fills the article molds and at least a portion of the runners 40. In one specific instance, the molten metal was a nickel-chrome super alloy and the article molds had a configuration corresponding to the configuration of turbine blades. However, it should be understood that the apparatus and method of the present invention can be utilized to cast different articles out of different metals.

Figure 3:
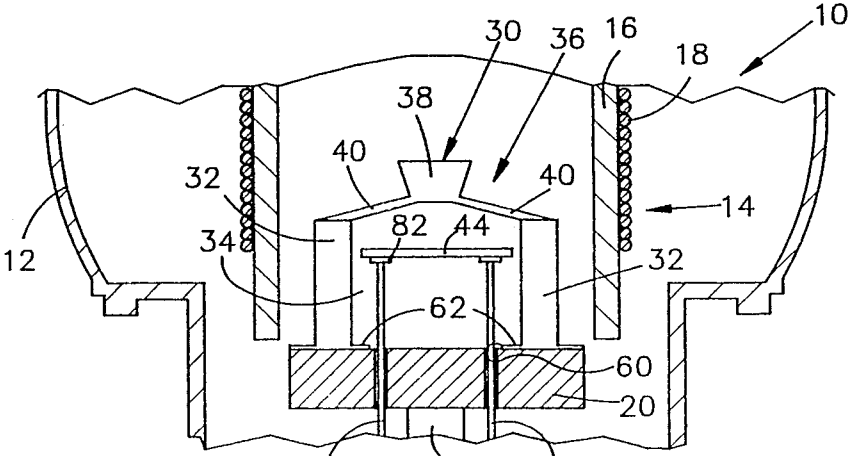
FIG. 3 is a schematic illustration, generally similar to FIG. 1, illustrating the relationship between the chill plate, mold structure, baffle plate and furnace when the mold structure has been partially withdrawn from the furnace.

When the article molds 32 have been filled with molten metal and an equilibrium condition reached, the motor 24 is continuously operated to lower the support post 22 and chill plate 20. As the mold structure 30 is lowered with the chill plate 20, the lower end portions of the article molds 32 move downwardly past the stationary baffle plate 44 and are exposed to the central portion of the chill plate 20 (FIG. 3). The baffle plate 44 retards the transfer of heat from the upper portions of the article molds 32 through the open central space 34 to the chill plate 20.

The baffle plate 44 has a relatively large diamter, that is a diameter which is greater than the diameter of the opening 60 in the base 62, to facilitate the establishment of a relatively large heat gradient across the baffle plate. The annular rim portion 66 of the baffle plate overlies the annular inner edge portion of the base 62 as the mold is lowered from the furnace. Therefore, the portions of the article molds 32 above the baffle plate 44 are not directly exposed to the upper side surface 76 of the chill plate 20 at the opening 60 in the base 62. This results in the metal in the article molds 32 solidifying upwardly away from the chill plate 20 as the chill plate and mold structure 30 are lowered.

The baffle plate support rods 84 and baffle plate 44 are held against axial movement by the retainers 54 as the chill plate 20 is lowered through a distance equal to the height of the article molds 32. When the chill plate 20 and mold structure 30 have been lowered through a distance sufficient to move the gating system 36 into engagement with the stationary baffle plate 44, the molten metal in the article molds will have solidified. Therefore, it is no longer necessary to use the baffle plate 44 to retard the transfer of heat from the article molds 32 to the chill plate 20.

Continued downward movement of the chill plate 20 and mold structure 30 after engagement of the gating system 36 with the baffle plate 44 results in the application of downwardly directed forces against the baffle plate by the gating system 36. These forces are transmitted from the baffle plate 44 to the support structure 50. The force is sufficient to overcome the attraction of the magnetic retainers 54 so that the support rods 58 move the base plate 64 away from the retainers 54. This releases the baffle plate support structure 50 for downward movement. The baffle plate 44 then drops downwardly onto the chill plate 20. The construction of the support structure 50 and the manner in which it cooperates with the chill plate 20 is the same as is disclosed in U.S. patent application Ser. No. 013,469, filed Feb. 11, 1987 by Lawrence D. Graham et al. and entitled "Method and Apparatus for Use in Casting Articles".

Inserting Baffle Plate

The baffle plate 44 has a larger diameter than the diameter of the opening 60 in the base 62. Therefore, the baffle plate 44 cannot be moved straight through the opening 60 into the open central space 34 between the article molds 32. Although it would be possible to increase the size of the opening 60 in the base 62, this would result in a smaller area of engagement between the base of the mold structure 30 and the chill plate 20. The reduced area of engagement between the base 62 of the mold structure 30 and the chill plate 20 would be detrimental to the obtaining of a fluid tight seal between the open lower ends of the article molds 32 and the chill plate. In addition, increasing the size of the opening 60 would be detrimental to the stability of the article molds 32 which are interconnected by the annular base 62.

In accordance with one of the features of the present invention, the baffle plate 44 is provided with a slit 92 (FIG. 4) which extends from a circular outer side surface 94 of the baffle plate into the central portion 96 of the baffle plate. It should be understood that the baffle plate 44 is normally flat and has been shown resiliently deflected in FIG. 4 to clearly illustrate the location of the slit 92. The baffle plate 44 is returned to its flat condition, shown in FIGS. 1 and 3, after being inserted into the open central space 34 between the article molds 32.

The spiral slit 92 is defined by a pair of arcuate side surfaces 102 and 104 in the material of the baffle plate 44. The slit 92 is formed without removing any of the material of the baffle plate 44. Therefore, when the baffle plate 44 is released in the open central space 34, the opposite sides 102 and 104 of the slit move into abutting engagement. Although it is preferred to form the slit 92 without having a gap between the opposite sides 102 and 104, the slit 92 could be formed as a long narrow opening if desired.

The slit 92 enables the relatively large diameter baffle plate 44 to be inserted through the relatively small diameter opening 60 in the base 62 of the mold structure 30. When the baffle plate 44 is to be inserted into the open central space 34, the one-piece mold structure 30 is placed in an upside down orientation (FIG. 5), that is, an orientation in which the gating system 36 is downwardly and the base 62 is upwardly. The mold structure 30 is supported in an upside down orientation on a table 108 having a flat upper side surface 110 which engages the pour cup 38. This orientation of the mold structure 30 exposes the opening 60 to facilitate insertion of the baffle plate 44.

Figure 4:
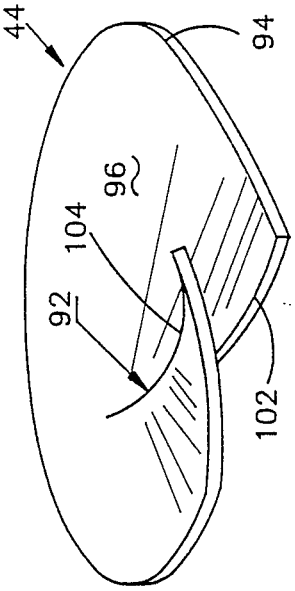
FIG. 4 is an enlarged pictorial illustration of a baffle plate which has been deflected to open a slit in the baffle plate.

When the baffle plate 44 is to be inserted into the open central space 34 through the opening 60, the baffle plate is resiliently deflected, in the manner shown in FIG. 4, to open the slit 92. An annular inner flange 112 on the base 62 (FIG. 5) is inserted into the open slit 92. At this time, a portion of the baffle plate 44 will be in the open central space 34 and another portion of the baffle plate will be outside of the open central space.

Once the inner flange 112 of the base 62 has been inserted into the slit 92, the baffle plate 44 is rotated about its generally vertical central axis 114 which is coincident with the central axis of the mold structure 30. As the baffle plate 44 is rotated, in the manner indicated by the arrow 116 in FIG. 6, the baffle plate is turned into the open central space 34 with a screwing action.

Once the baffle plate 44 has been turned into the open central space 34, the slit 92 is closed. The mold structure 30 is then turned right side up, that is with the gating system 36 upwardly and the base 62 downwardly. The right side up mold structure 30 is moved to and positioned on the chill plate 20. During transporting of the mold structure 30 to the chill plate 20, the baffle plate 44 remains in the open central space 34 between the article molds 32.

Figure 6:
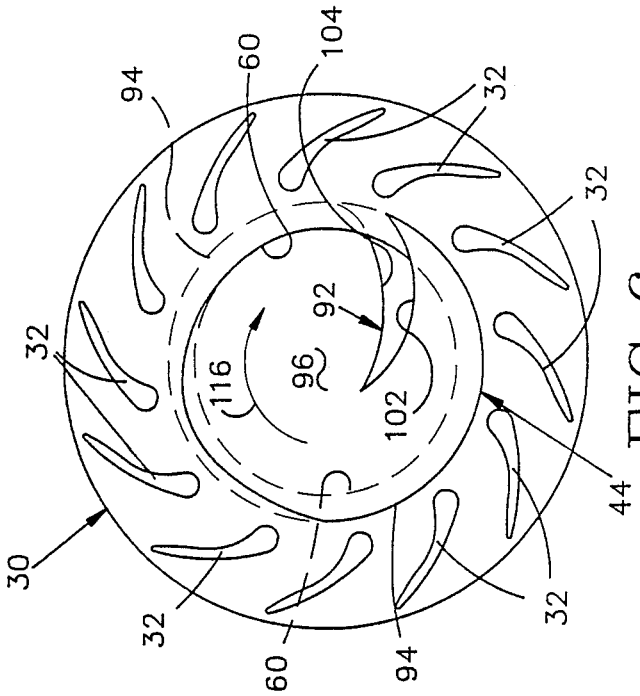
FIG. 6 is a top plan view, taken on a reduced scale along the line 6—6 of FIG. 5, illustrating the manner in which the baffle plate is rotated during insertion of the baffle plate into the open central space in the mold structure.
Figure 5:
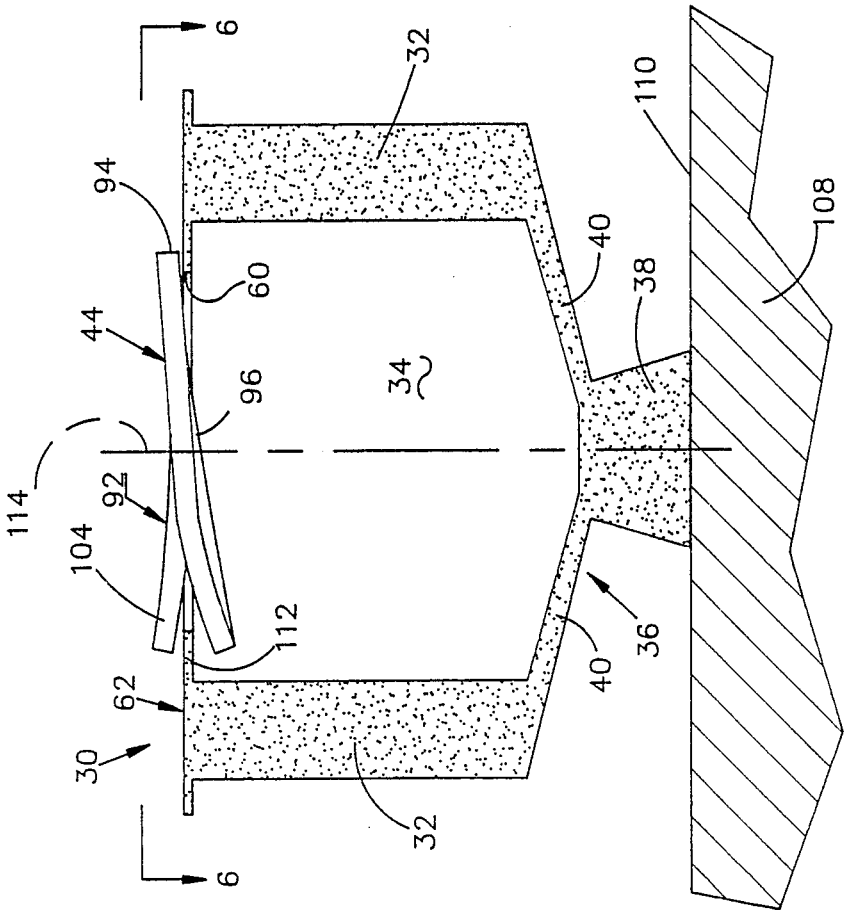
FIG. 5 is a schematic illustration depicting the mold structure of FIG. 1 in an upside down orientation and depicting the manner in which the baffle plate of FIG. 4 is inserted into an open central space in the mold structure.

Although it is preferred to insert the slitted baffle plate 44 with a turning action, in the manner illustrated in FIGS. 5 and 6, the baffle plate could be inserted in other ways. For example, the baffle plate 44 could be held in an upright orientation with opposite major side surfaces of the baffle plate extending parallel to the central axis 114 of the mold structure 30. The base 62 would then be inserted into the slit 92 until the opposite edge portion of the baffle plate 44 just cleared the edge of the opening 60. The baffle plate 44 would then be rotated and moved downwardly into the open central space 34. As this movement occurred, the baffle plate 44 would also be moved away from the portion of the base 62 disposed in the slit 92 to withdraw the base from the slit.

Inserting Baffle Plate—Alternative Method

Figure 7:
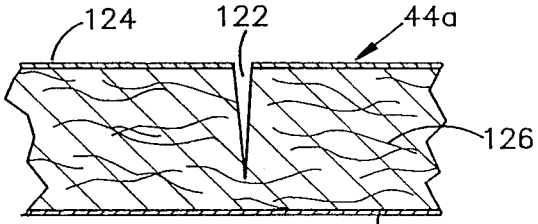
FIG. 7 is an enlarged fragmentary sectional view of a portion of a second embodiment of the baffle plate and illustrating a slit which forms a fold line in the baffle plate.

In the embodiment of the invention described in conjunction with FIGS. 4–6, a slit 92 is formed in the baffle plate 44 and the baffle plate is inserted into the open central space 34 through the opening 60 in the base by turning the baffle plate 44. In the embodiment of the invention illustrated in FIGS. 7–9, the baffle plate is folded to enable it to be inserted into the open central portion of a mold structure. Since the components of the embodiment of the invention illustrated in FIGS. 7–9 are generally similar to the components of the embodiment of the invention illustrated in FIGS. 4–6, similar numerals will be utilized to designate similar components, the suffix letter "a" being associated with FIGS. 7–9 to avoid confusion.

A circular baffle plate **44*a* is provided with a straight slit 122 which extends diametrically across the baffle plate. The slit 122 extends only part way through the baffle plate. Thus, the slit extends through an upper layer 124 of graphite foil and part way through a central core 126 of graphite fibers. The slit 122 does not extend completely through the central core 126 of graphite fibers and does not extend through a lower layer 128 of graphite foil. The slit 122 forms a fold line which extends diametrically across the circular baffle plate 44*a***.

Figure 9:
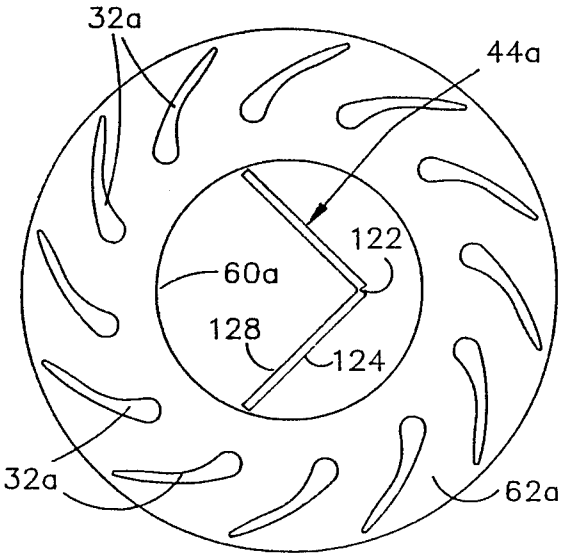
FIG. 9 is a plan view, taken on a reduced scale along the line 9—9 of FIG. 8, illustrating the manner in which the folded baffle plate is inserted through an opening in a base of the mold structure.
Figure 8:
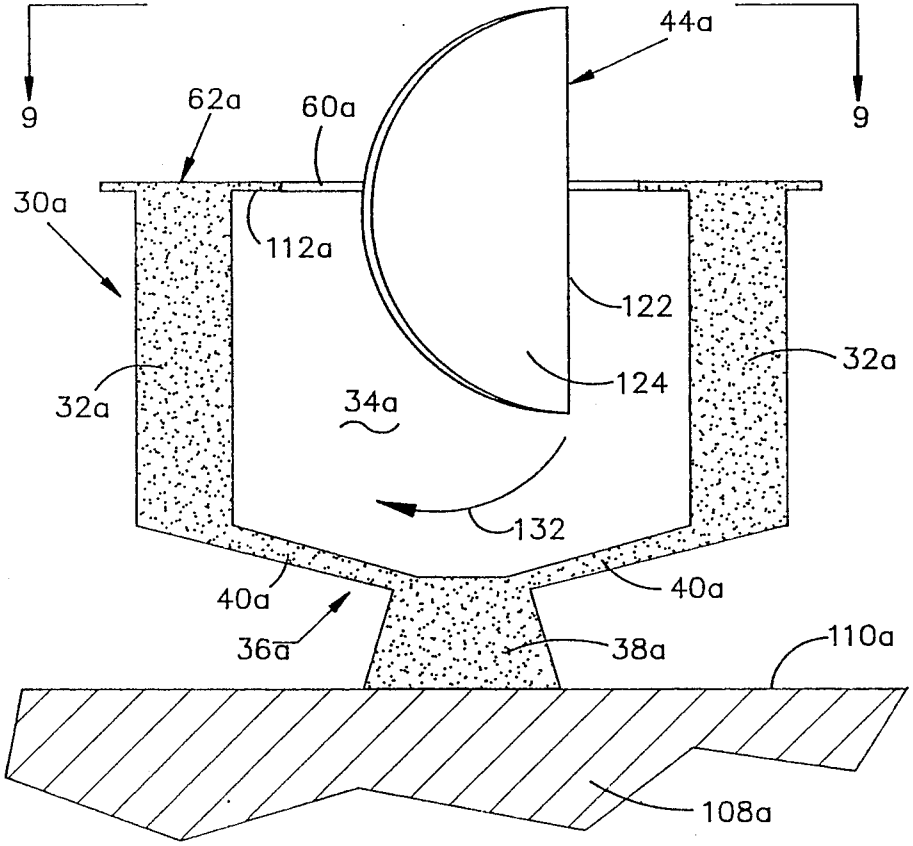
FIG. 8 is a schematic illustration depicting the mold structure of FIG. 1 in an upside down orientation and depicting the manner in which the folded baffle plate of FIG. 7 is inserted into an open central space in the mold structure.

The circular baffle plate **44*a* is folded from a flat configuration to the partially folded configuration shown in FIGS. 8 and 9 by moving the baffle plate 44 downwardly (as viewed in FIG. 7) on opposite sides of the slit 122. This bends the baffle plate 44*a* along the slit 122. The unsevered portion of the graphite fibers in the core 126 and the lower layer 128 of graphite foil provide a hinge which interconnects the opposite sides of the baffle plate 44*a*. It is contemplated that the baffle plate 44*a*** could be reinforced in the area of the hinge if desired.

When the baffle plate **44*a* is to be inserted into the mold structure 30*a*, the mold structure is placed on an upper side surface 110*a* on a table 108*a* in the upside down orientation illustrated in FIG. 8. The folded baffle plate 44*a* is then inserted downwardly through the opening 60*a*. Since the baffle plate 44*a* has been folded, it can be inserted into the opening 60*a* even though the opening 60*a* has a diameter which is smaller than the unfolded diameter of the baffle plate 44*a* (FIG. 9**).

Once the folded baffle plate **44*a* has been inserted part way through the opening 60*a* into the open central space 34*a*, in the manner illustrated in FIG. 8, the baffle plate is rotated about a horizontal axis, in the manner indicated schematically by the arrow 132. As the baffle plate 44*a* is moved downwardly and rotated, the upper portion of the baffle plate 44*a* moves through the opening 60*a* into the open central space 34*a* between the article molds 32*a*. Once the baffle plate 44*a* has been inserted through the opening 60*a* into the open central space 34*a***, the baffle plate is unfolded to a flat configuration.

The circular baffle plate **44*a* has a larger diameter than the diameter of the circular opening 60*a*. Therefore, once the baffle plate 44*a* has been unfolded to a flat configuration in the space 34*a* and the mold 30*a* turned to an upright orientation, the baffle plate 44*a* will be disposed in abutting engagement with an upper side surface of the radially inwardly projecting flange 112*a* of the base 62*a* at an annular area which extends completely around the opening 60*a*. The mold structure 30*a* is then transported to and placed on a chill plate in an upright orientation with the baffle plate 44*a*** in an unfolded, flat configuration.

Conclusion

In view of the foregoing description, it is apparent that the present invention provides a new and improved method and apparatus 10 for use in casting a plurality of articles. The apparatus includes a mold structure 30 having article molds 32 disposed in an array with an open central space 34 in which a baffle plate 44 is disposed. The baffle plate 44 has an area which is greater than the area of an opening 60 in the base 62. This results in the baffle plate 44 overlying an area on the base extending around the opening (FIG. 2).

Since the baffle plate 44 overlies an area on the base and extends around the opening 60, the periphery of the baffle plate is relatively close to the article molds 32. Therefore, when the mold structure 30 is lowered from a furnace 14, the stationary baffle plate 44 is effective to establish a relatively large heat gradient between the portions of the article molds 32 disposed above the baffle plate and the portions of the article molds disposed below the baffle plate.

The relatively large baffle plate 44 is inserted into the open central space 34 between the article molds 32 through an opening 60 in the base of the mold structure 30. The opening 60 in the base of the mold structure is smaller than the baffle plate 44. Therefore, various methods have been developed to insert the baffle plate 44 through the opening.

One of the methods for inserting the baffle plate 44 through the opening 60 includes providing a slit 92 in the baffle plate. The base 62 of the mold structure 30 is received in the slit 92 (FIG. 5). The baffle plate 44 is then rotated (FIG. 6) to turn the baffle plate through the opening 60 in the base 62 of the mold structure 30 into the open central space 34 between the article molds 32. An alternative method for inserting the baffle plate is to partially fold the baffle plate **44*a* before inserting it through the opening 60*a* (FIGS. 8 and 9). The baffle plate 44*a* is unfolded when it is in the space 34*a* between the article molds 32*a***.

The inserting of the baffle plate 44 into the open central space 34 between the article molds 32 is advantageously accomplished with the mold structure 30 in an upside down orientation (FIG. 8), that is with the base 62 of the mold structure upward. Once the baffle plate 44 has been inserted, the mold structure 30 is turned over so that the base 62 of the mold is downward. The mold structure 30 is then moved to and positioned on a chill plate 20 (FIG. 1) with the baffle plate 44 in the open central space 34 between the article molds 32.

Having described specific preferred embodiments of the invention, the following is claimed:

1. A method of casting a plurality of articles, said method comprising the steps of providing a mold structure having a plurality of article molds disposed in an array with an open central space and a base connected to the article molds and having an opening to the open central space, providing a baffle plate having an area which is greater than the area of the opening in the base of the mold structure, inserting the baffle plate through the opening in the base of the mold structure into the open central space, positioning the mold structure on a chill plate, conducting molten metal to the article molds, and retarding the transfer of heat from the article molds to the chill plate with the baffle plate.

2. A method as set forth in claim 1 wherein said step of positioning the mold structure on the chill plate is performed with the baffle plate in the open central space.

3. A method as set forth in claim 1 wherein at least a portion of said step of retarding the transfer of heat from the article molds to the chill plate with the baffle plate is performed with a lower side of the baffle plate in engagement with an upper side of the base in an area which extends completely around the opening in the base.

4. A method as set forth in claim 1 further including the step of lowering the chill plate and mold structure relative to the baffle plate with a rim portion of the baffle plate overlying an area of the base extending completely around the opening in the base.

5. A method as set forth in claim 1 wherein the opening in the base has a circular configuration with a first diameter and the baffle plate has a circular configuration with a second diameter which is greater than the first diameter.

6. A method as set forth in claim 1 wherein said step of inserting the baffle plate through the opening in the base of the mold structure is performed with the mold structure in a first orientation in which the base of the mold structure is the uppermost portion of the mold structure, said step of positioning the mold structure on the chill plate includes positioning the mold structure on the chill plate in a second orientation in which the base of the mold structure is the lowermost portion of the mold structure.

7. A method as set forth in claim 1 wherein said step of inserting the baffle plate through the opening in the base of the mold structure includes moving the baffle plate downwardly through the opening in the base of the mold structure.

8. A method as set forth in claim 1 wherein said step of inserting the baffle plate through the opening in the base of the mold structure includes rotating the baffle plate relative to the base of the mold structure.

9. A method as set forth in claim 8 wherein said step of rotating the baffle plate relative to the base of the mold structure is at least partially performed with a portion of the baffle plate disposed in the open central space and a portion of the baffle plate disposed outside of the open central space.

10. A method as set forth in claim 8 wherein said step of rotating the baffle plate relative to the base of the mold structure includes rotating the baffle plate about an axis which extends through the opening in a direction parallel to the direction of insertion of the baffle plate through the opening.

11. A method as set forth in claim 8 wherein said step of rotating the baffle plate relative to the base of the mold structure includes rotating the baffle plate about an axis which extends transverse to the direction of insertion of the baffle plate through the opening.

12. A method as set forth in claim 1 further including steps of lowering the chill plate and mold structure relative to the baffle plate while transmitting force through the chill plate to support the baffle plate.

13. A method as set forth in claim 1 wherein said step of providing a baffle plate includes providing a baffle plate having a slit which extends from an outer edge of the baffle plate into a central portion of the baffle plate, said step of inserting the baffle plate through the opening includes inserting the base of the mold structure into the slit.

14. A method as set forth in claim 13 wherein said step of inserting the baffle plate through the opening further includes rotating the baffle plate relative to the base of the mold structure with the base extending through the slit.

15. A method as set forth in claim 1 wherein said step of providing a baffle plate includes providing a baffle plate having a slit which is at least partially defined by a pair of opposite side surfaces, said step of inserting the baffle plate through the opening in the base includes moving the baffle plate to a position in which a portion of the base is disposed between the opposite side surfaces of the slit in the baffle plate.

16. A method as set forth in claim 15 wherein said step of inserting the baffle plate through the opening in the base further includes moving the baffle plate to a position in which it is within the open central space and the base is spaced apart from the slit.

17. A method as set forth in claim 16 wherein said step of moving the baffle plate to a position in which it is within the open central space includes rotating the baffle plate about an axis which extends through the opening in the base.

18. A method as set forth in claim 1 wherein said step of inserting the baffle plate through the opening in the base of the mold structure includes the steps of at least partially folding the baffle plate, moving the folded baffle plate through the opening, and unfolding the baffle plate in the open central space.

19. A method of casting a plurality of articles, said method comprising the steps of providing a mold structure having a plurality of article molds disposed in an array with an open central space, a gating system connected with first end portions of the article molds, and a base connected with second end portions of the article molds and having an opening to the open central space, providing a baffle plate, inserting the baffle plate through the opening in the base into the open central space while the mold structure is at a first location spaced apart from a chill plate and while the mold structure is in a first orientation with the base above the gating system to expose the opening in the base, thereafter, moving the mold structure from the first location onto the chill plate with the baffle plate in the open central space, said step of moving the mold structure onto the chill plate including positioning the mold structure on the chill plate in a second orientation with the gating system above the base, conducting molten metal to the article molds, and retarding the transfer of heat from the article molds to the chill plate with the baffle plate.

20. A method as set forth in claim 19 wherein said step of providing a baffle plate includes providing a baffle plate having an area which is greater than the area of the opening in the base.

21. A method as set forth in claim 20 wherein said step of inserting the baffle plate into the open central space includes at least partially folding the baffle plate, moving the folded baffle plate into the open central space, and unfolding the baffle plate in the open central space.

22. A method as set forth in claim 20 wherein said step of providing a baffle plate includes providing a baffle plate having a slit with a pair of opposite side surfaces, said step of inserting the baffle plate through the opening in the base into the open central space includes moving the baffle plate to a position in which a portion of the base is disposed between opposite side surfaces of the slit in the baffle plate and subsequently moving the baffle plate to a position in the open central space in which base is out from between the opposite side surfaces of the slit.

23. A method as set forth in claim 20 wherein the baffle plate overlies an area on the base extending completely around the opening in the base when the mold structure is in the second orientation on the chill plate.

24. A method of casting a plurality of articles, said method comprising the steps of providing a mold structure having a plurality of article molds disposed in an array with an open central space, a gating system connected to ends of the article molds and extending across the open central space, and a base connected to ends of the article molds opposite from the gating system, providing a baffle plate having a slit which extends from an outer edge of the baffle plate into a central portion of the baffle plate, inserting the baffle plate into the open central space, said step of inserting the baffle plate into the open central space includes moving the mold structure and baffle plate relative to each other to insert at least a portion of the base of the mold structure into the slit, positioning the mold structure on a chill plate, conducting molten metal through the gating system to the article molds, and retarding the transfer of heat from the article molds to the chill plate with the baffle plate.

25. A method as set forth in claim 24 wherein the base of the mold structure includes an opening to the open central space, said step of inserting the baffle plate into the open central space includes moving the baffle plate through the opening in the base of the mold structure.

26. A method as set forth in claim 24 wherein said step of inserting the baffle plate into the open central space further includes rotating the baffle plate relative to the base of the mold structure with a portion of the base extending through the slit.

27. A method as set forth in claim 24 wherein said step of inserting the baffle plate into the open central space is performed while the mold structure is in a first orientation at a first location spaced apart from the chill plate, said step of positioning the mold structure on the chill plate including moving the mold structure from the first location to the chill plate with the baffle plate in the open central space and positioning the mold structure on the chill plate with the mold structure in a second orientation which is different than the first orientation.

28. A method of casting a plurality of articles, said method comprising the steps of providing a mold structure having a plurality of article molds disposed in an array with an open central space, a gating system connected to ends of the article molds and extending across the open central space, and a base connected to ends of the article molds opposite from the gating system, providing a baffle plate, at least partially folding the baffle plate, inserting the folded baffle plate into the open central space, unfolding the baffle plate in the open central space, positioning the mold structure on a chill plate, conducting molten metal through the gating system to the article molds, and retarding the transfer of heat from the article molds to the chill plate with the unfolded baffle plate.

29. A method as set forth in claim 28 wherein the base of the mold structure includes an opening to the open central space, said step of inserting the folded baffle plate into the open central space includes moving the folded baffle plate through the opening in the base of the mold structure.

30. A method as set forth in claim 28 wherein said step of inserting the folded baffle plate into the open central space includes moving the folded baffle plate in a direction transverse to a central axis of the mold structure.

31. A method as set forth in claim 28 wherein said step of unfolding the baffle plate in the open central space includes moving portions of the baffle plate in a direction transverse to the path of insertion of the baffle plate into the open central space.

32. A method as set forth in claim 28 wherein said step of inserting the folded baffle plate into the open central space is performed while the mold structure is at a first location spaced from the chill plate, said step of positioning the mold structure on the chill plate including moving the mold structure from the first location to the chill plate with the baffle plate in the open central space 33. An apparatus for use in casting a plurality of articles, said apparatus comprising a mold structure, said mold structure including a plurality of article molds disposed in an array having an open central space, gating means connected with upper end portions of said article molds and extending across the open central space for conducting molten metal to said article molds, and a base connected to lower end portions of said article molds, said base including surface means for defining an opening to the open central space, and baffle means disposed in the open central space for retarding the transfer of heat from said article molds, said baffle means having a lower side with an area which is greater than the area of the opening in said base, said lower side of said baffle means overlying an area on said base extending around the opening in said base.

34. An apparatus as set forth in claim 33 wherein said baffle means includes surface means for defining a slit which extends from an outer edge of said baffle means to a central portion of said baffle means.

35. An apparatus as set forth in claim 33 wherein said baffle means includes surface means for defining a fold line which extends across said baffle means between opposite edge portions of said baffle means.

36. An apparatus as set forth in claim 33 wherein said baffle means includes means for defining an opening for receiving at least a portion of said base during insertion of said baffle means into the open central space.

* * * * *